US008863910B2

(12) United States Patent
Sonnenmoser et al.

(10) Patent No.: US 8,863,910 B2
(45) Date of Patent: Oct. 21, 2014

(54) ELEVATOR SHAFT DOOR OPENING AUTHORIZING SAFETY DEVICE

(75) Inventors: Astrid Sonnenmoser, Ebikon (CH); Martin Hess, Baar (CH); David Michel, Thalwil (CH)

(73) Assignee: Inventio AG, Hergiswil (CH)

( * ) Notice: Subject to any disclaimer, the term of this patent is extended or adjusted under 35 U.S.C. 154(b) by 672 days.

(21) Appl. No.: 13/142,332

(22) PCT Filed: Dec. 18, 2009

(86) PCT No.: PCT/EP2009/067474

§ 371 (c)(1),
(2), (4) Date: Jun. 27, 2011

(87) PCT Pub. No.: WO2010/072658

PCT Pub. Date: Jul. 1, 2010

(65) Prior Publication Data

US 2011/0272218 A1 Nov. 10, 2011

(30) Foreign Application Priority Data

Dec. 26, 2008 (EP) ..... 08172951

(51) Int. Cl.

| | |
|---|---|
| ***B66B 1/34*** | (2006.01) |
| ***B66B 13/22*** | (2006.01) |
| *B66B 13/16* | (2006.01) |
| *B66B 1/24* | (2006.01) |

(52) U.S. Cl.

CPC ..... *B66B 13/22* (2013.01); *B66B 13/165* (2013.01); *B66B 1/2433* (2013.01)

USPC ..... 187/391; 187/249

(58) Field of Classification Search

CPC ..... B66B 1/24; B66B 1/2433; B66B 1/2458; B66B 1/2466

USPC ..... 187/247, 248, 249, 380–388, 391–394

See application file for complete search history.

(56) References Cited

U.S. PATENT DOCUMENTS

| | | | | |
|---|---|---|---|---|
| 6,619,437 | B2 * | 9/2003 | Hikita | 187/383 |
| 7,178,635 | B2 * | 2/2007 | Meissner et al. | 187/249 |
| 7,353,914 | B2 * | 4/2008 | Deplazes | 187/313 |
| 7,487,860 | B2 * | 2/2009 | Hikita et al. | 187/249 |
| 8,230,977 | B2 * | 7/2012 | Thumm et al. | 187/247 |
| 8,348,018 | B2 * | 1/2013 | Kostka | 187/249 |
| 2005/0082121 | A1 | 4/2005 | Deplazes | |
| 2007/0089935 | A1 * | 4/2007 | Hikita | 187/249 |

(Continued)

FOREIGN PATENT DOCUMENTS

| | | | |
|---|---|---|---|
| EP | 1618059 | B1 | 1/2007 |
| WO | 2009073025 | A1 | 6/2009 |

*Primary Examiner* — Anthony Salata

(74) *Attorney, Agent, or Firm* — Fraser Clemens Martin & Miller LLC; William J. Clemens

(57) ABSTRACT

An elevator system has at least two elevator cars, each of which has at least one elevator car door and each of which is provided for independent displacement in a common shaft, and a plurality of shaft doors and a safety device having at least one door opening sensor, at least one evaluation unit and at least one data line between the door opening sensor and the evaluation unit. The evaluation unit evaluates at least one signal of the door opening sensor in at least one evaluation step to prevent unauthorized opening of the shaft door.

14 Claims, 2 Drawing Sheets

(56) References Cited

U.S. PATENT DOCUMENTS

2007/0181374 A1* 8/2007 Mueller ..... 187/249
2011/0024239 A1* 2/2011 Kocher et al. ..... 187/249
2011/0042168 A1* 2/2011 Grundmann ..... 187/249

* cited by examiner

ELEVATOR SHAFT DOOR OPENING AUTHORIZING SAFETY DEVICE

FIELD OF THE INVENTION

The invention relates safety devices for an elevator installation having at least two elevator cars in a common elevator shaft.

BACKGROUND OF THE INVENTION

An elevator installation with a shaft in which two elevator cars arranged one above the other are movable upwardly and downwardly, wherein the shaft has a plurality of shaft doors and the elevator cars each have at least one elevator car door, is already known from the specification EP 1 618 059 B1.

In order to avoid potentially risky operating situations the elevator installation has a safety device, which comprises so-called safety circuits and by means of which safety-relevant components such as shaft doors, elevator cars doors, shaft limit switches, buffers and speed cable, are monitored by sensors, which are each coupled with a respective switch. The switches arranged in a safety circuit are connected in series, wherein a closed switch indicates a safe state of the component of the elevator installation. Opening of a single switch is sufficient for interruption of the safety circuit, whereupon at least the elevator drive is interrupted.

Each of the elevator cars of the elevator shaft has an individual safety circuit which monitors the respective travel region of the elevator car so that opening of a safety circuit in defined cases has no immediate effects on operation of the other elevator cars, whereby a part of the transport capacity of the elevator installation is maintained.

SUMMARY OF THE INVENTION

The invention has, in particular, the object of providing an elevator installation by means of which a small outlay on installation and flexible adaptation with, at the same time, guaranteed transport capacity of the elevator installation can be achieved.

An elevator installation is proposed with at least two elevator cars, which each have at least one elevator car door and which are provided for the purpose of being moved independently of one another in a common shaft, and with a plurality of shaft doors and a safety device, which comprises at least one door opening sensor, at least one evaluating unit and at least one data line between the door opening sensor and the evaluating unit, wherein the evaluating is provided for the purpose of evaluating a signal of the door opening sensor in at least one evaluating process.

By "door opening sensor" there is to be understood in this connection, in particular, a measured value pick-up which is provided for the purpose of detecting an opened and/or a closed state of a door. In an advantageous embodiment the door opening sensor can be formed by an electrical switch.

By "evaluating unit" there is to be understood in this connection, in particular, a unit which comprises a computer unit, a memory unit and, in particular, an operating program stored in the memory unit and which is equipped particularly for the purpose of picking up electrical characteristic magnitudes of external sensors and, in particular, digitally converting them and actuating external actuators for control and/or regulation.

It is possible by means of such an elevator installation to replace a conductive wiring of elements of a safety device at least partly by a computer-assisted, logical linking of the elements, whereby considerable savings in an installation can be achieved with, at the same time, guaranteed transport capacity of the elevator installation. A computer-assisted, logical linking of the elements is flexibly and quickly adaptable to different use conditions and to new and/or changed safety conditions, particularly to inspection and repair situations. Moreover, with advantage it is possible to avoid bridging-over of door sensors.

It is proposed that the door opening sensor is formed by a shaft door opening sensor. The wiring connection of the shaft door opening sensors represents a substantial proportion of installation outlay on a safety device, which can be significantly reduced by the proposal.

Moreover, it is proposed that the door opening sensor is formed by an elevator car door opening sensor. Through the inclusion of the elevator car door opening sensors, computer-assisted logical connections of the safety elements can be constructed, and adapted to a safety concept, in a very flexible manner.

Moreover, it is proposed that the data line is formed by a bus which is connected with the door opening sensor by way of at least one bus junction. By "bus" there is to be understood in this connection, in particular, a special line which is specifically provided for the purpose of enabling information exchange between more than two apparatus connected in parallel with this line and which represents, in particular, a part of a system bus.

By "system bus" there shall be understood in this connection, in particular, a data line and preferably a set of data lines which is or are provided for the purpose of addressing and communicating data and transmitting signals between the evaluating unit and other elements of the safety device. In particular, the system bus comprises a data bus, an address bus and a signal bus. Moreover, by "bus junction" there is to be understood in this connection, in particular, an interface provided for the purpose of providing for the bus at least one electrical characteristic magnitude of the door opening sensor in a form compatible with the bus, wherein the bus junction can be formed by a unit separate from the door opening sensor or also integrated at least partly in the door sensor. The outlay on installation can be further reduced by an appropriate design and a more flexible exchange of information can be achieved in simple manner. With particular advantage the evaluating unit is provided for the purpose of periodically collecting the data of all door opening sensors of the safety device by means of the system bus.

It is further proposed that the elevator installation comprises a braking unit and a control line between the braking unit and the evaluating unit. In particular, the evaluating unit can carry out activation and/or deactivation of the braking unit by means of the control line and on the basis of collected data and the algorithms filed in the operating program.

In a further embodiment of the invention it is proposed that the control line between the braking unit and the evaluating unit is formed by a signal bus as part of the system bus. In particular, the outlay on installation for the signal line between the braking unit and evaluating unit can thereby be reduced, since the connection of the braking unit has to be made only to the closest system bus connection.

It is further proposed that the elevator installation comprises an elevator car position unit which is provided for the purpose of detecting an absolute position of at least one elevator car within the shaft. In particular, new options for safety monitoring can be opened up by provision of the absolute elevator car positions at the evaluating unit.

In an advantageous embodiment the elevator installation comprises an evaluating unit with at least one memory unit with a learning program stored therein for detection of a data set. Advantageously, the data set comprises at least in part an absolute position of at least one shaft door within the shaft. With particular advantage, absolute positions of existing shaft doors can be stored in the data set of the evaluating unit by means of the learning program at the time of performance of a learning travel of an elevator car. Alternatively, it would be conceivable for the data to be manually input by an operator and/or to be copied over from a third unit to the evaluating unit.

Moreover, it is proposed that the evaluating unit is provided for the purpose of monitoring at least one elevator car speed and/or at least one relative spacing of two elevator cars, whereby further boundary conditions can advantageously be incorporated in a monitoring process. Advantageously, the evaluating unit can be designed and programmed for the purpose of monitoring, with the help of real-time functions and with reference to the absolute positions of the elevator car at different points in time, the instantaneous travel speed thereof and/or the relative spacing of two cars and, in the case of exceeding determined limit values, activating predetermined measures such as, for example, staged braking processes. In performance of an evaluating process the evaluating unit can grant shaft door opening authorizations advantageously after each periodic data collection and typically several times in a second depending on positions, speeds and travel directions of elevator cars.

In addition, it is proposed that the evaluating unit is provided for the purpose, for isolated monitoring of at least one of the car doors, of granting an opening authorization to a shaft door when the elevator car is disposed in the approach region of the shaft door and a limit value for a maximum speed of the elevator car is fallen below, whereby advantageously a safe opening of elevator car door and shaft door on reaching a destination floor is guaranteed.

By "opening authorization" for a shaft door there is to be understood in this connection, in particular, that the shaft door can be opened without infringement of a monitoring rule. By "monitoring rule" there is to be understood in this connection, in particular, a logical linking at least of signals of door opening sensors and of opening authorizations for shaft doors, which advantageously can be filed in the programming of the evaluating unit. In particular, a monitoring rule can also embrace signals of other safety-relevant components, for example elevator car door opening sensors. By "monitoring" there is to be understood in this connection, in particular, an evaluation of monitoring rules. Depending on the result of the evaluation process, the evaluating unit can perform executable program parts which are advantageously filed in the programming of the evaluating unit. These program parts relate to, in particular, activation and/or deactivation of the braking unit. By "isolated monitoring" of an elevator car there is to be understood in this connection, in particular, monitoring by the evaluating unit which concerns only this elevator car, wherein data about further elevator cars can also be included in monitoring rules for monitoring the elevator car.

By "approach region" of the shaft door there is to be understood in this connection, in particular, a region of less than 0.7 meters and advantageously less than 0.5 meters below and above the shaft door.

In an advantageous embodiment the evaluating unit is provided for the purpose—in at least one evaluating process in the case of occurrence of violation of a monitoring rule by performance of at least one executable program part, which advantageously is filed in the programming of the evaluating unit—of interrupting the travel of at least one elevator car and, in particular, stopping the drive of at least one elevator car to which the monitoring rule applies.

Moreover, it is proposed that the evaluating unit is provided for the purpose, for isolated monitoring of at least one of the elevator cars, of granting an opening authorization to at least one shaft door when a further elevator car is disposed between this shaft door and elevator car.

In particular, it can thereby be advantageously achieved that the travel of the elevator car further away from the shaft door can be continued if this shaft door was erroneously opened without authorization, whereby the availability of the elevator installation can be increased.

In a further embodiment, for isolated monitoring of one of the elevator cars, opening authorization can be granted to a shaft door when this shaft door lies outside a travel range released for the elevator car. It can also be advantageously achieved in this regard that this elevator car can continue its journey if the shaft door lying outside its travel range was opened without authorization, whereby the availability of the elevator cars in the elevator installation can be increased.

Moreover, it is proposed that the evaluating unit is provided for the purpose, in the case of at least one isolated monitoring of at least one of the elevator cars, of granting an opening authorization to at least one shaft door when the elevator car travels in a direction away from this shaft door. Due to the fact that travel past the shaft door in the case of an unauthorized opening is excluded it is possible to avoid interruption of travel, whereby the availability of elevator cars in the elevator installation can be improved.

It is proposed that the evaluating unit is provided for the purpose, in the case of at least one isolated monitoring of at least one of the car doors, to grant opening authorization to a shaft door if the shaft door lies outside a currently planned travel route of the elevator car to a destination floor. By "currently planned" travel route of an elevator car there is to be understood in this connection the travel path from a current position to the next requested destination floor lying in the current travel direction. Due to the fact that travel past the shaft door in a corresponding case is excluded, it is possible to forego interruption of the journey, whereby the availability of the elevator cars in the elevator installation can be improved.

In principle, further cases in which the evaluating unit grants opening authorization to a shaft door can be defined in very flexible manner so that in the case of opening of the shaft door during an evaluation the travel operation can nevertheless be continued. Thus, for example, the evaluating unit can be programmed for the purpose, in the case of unauthorized opening of a shaft door, of preventing travel into the approach region thereof or travel past.

It is also possible in the described manner to incorporate further safety-relevant elements, such as, for example, shaft limit switches and buffer switches, into the proposed safety device and use them in logical interlinkings for the monitoring. With particular advantage this takes place by way of a coupling by means of bus junctions with the system bus. However, in principle it would also be possible to arrange redundant monitoring procedures by additional lines separate from the system bus.

In an advantageous embodiment the safety device is also provided for monitoring a conventionally wired safety circuit. By "conventionally wired safety circuit" there is to be understood in this connection, in particular, an electrical circuit according to the specification EP 1 618 059 B1 in which safety-relevant components such as elevator car doors, shaft limit switches, buffers or a speed cable are monitored by sensors, which are each coupled with an electrical switch, and that these switches are serially connected in an electrical circuit. In particular, the safety device can in this manner be advantageously integrated in existing elevator installations and a complete re-installation of all safety-relevant components avoided without the flexibility of a computer-assisted, logical linking of safety-relevant components having to be dispensed with.

DESCRIPTION OF THE DRAWINGS

Further advantages are evident from the following drawing description. An exemplifying embodiment of the invention is illustrated in the drawing. The description and the claims contain numerous features in combination. The expert will advantageously also consider the features individually and combine them to form useful further combinations. There:

DETAILED DESCRIPTION OF THE INVENTION

Figure 1:
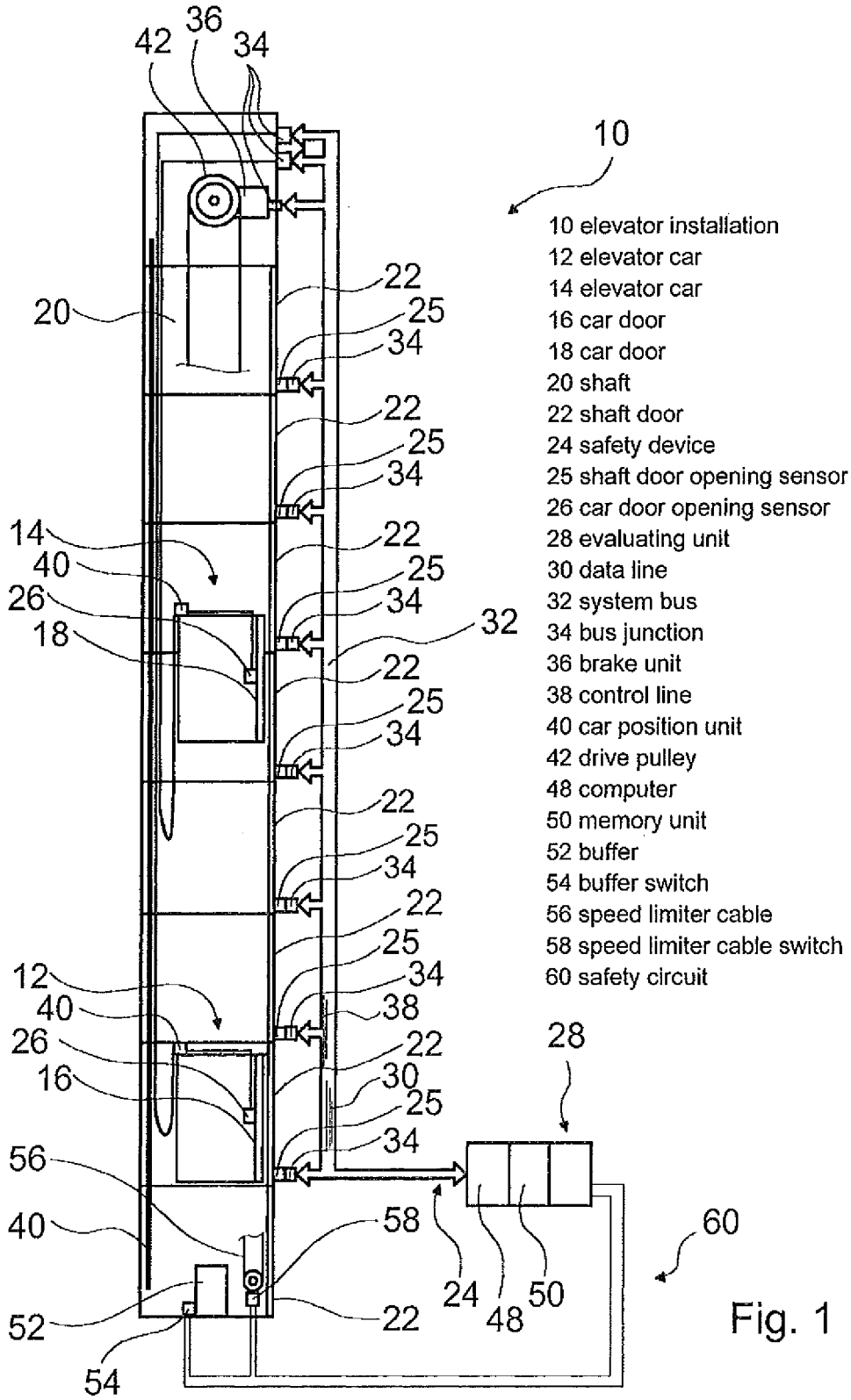
FIG. 1 shows an exemplifying embodiment of an elevator installation in a schematic illustration.

FIG. 1 shows a side view of an elevator installation 10 with driven drive pulleys 42 and two elevator cars 12 and 14, which respectively have an elevator car door 16 or 18 and which—one above the other—are each connected by a plurality of support cables with a respective counterweight, the cars being arranged in a common shaft 20 and movable independently of one another. The support cables and counterweights are, for reasons of clarity, not depicted. A buffer 52 is illustrated as representative of further safety-relevant components which could potentially be incorporated in the safety device. The elevator installation 10 comprises a plurality of shaft doors 22 and a safety device 24, which comprises a plurality of door opening sensors 25, 26 and, in particular, door opening sensors 25 formed by shaft door opening sensors and door opening sensors 26 formed by elevator car door opening sensors, an evaluating unit 28 and a data line 30 in the form of a data bus within a system bus 32, wherein the system bus 32 connects the door opening sensors 25, 26 and the evaluating unit 28. The evaluating unit 28 comprises a computer 48 and a memory unit 50 and is provided for the purpose of periodically performing evaluating processes and in that case, in particular, evaluating the signals of the door opening sensors 25, 26. The door opening sensors 25, 26 are coupled with the system bus 32 by means of bus junctions 34.

Mounted along the entire length of the shaft 20 is a strip with a code marking pattern as a stationary part of an elevator car position unit 40 for determination of the absolute position of the elevator cars 12 and 14. Mobile parts, which are installed at the elevator cars 12 and 14 and coupled with the system bus 32, of the elevator car position unit 40 read off the code marking pattern during travel of the elevator cars 12 and 14. A position measuring system of the described kind is disclosed in the specification WO 2003/011733A1.

The evaluating unit 28 is provided for the purpose of evaluating the data of the elevator car position unit 40 and monitoring the relative spacing of the two elevator cars 12 and 14. Moreover, the evaluating unit 28, which is furnished with real time functions, determines the absolute speed of the elevator cars 12 and 14 in operation from the data of the elevator car position unit 40 and monitors in the periodic evaluating processes the maintenance of a predetermined speed limit.

The evaluating unit 28 is connected by way of control lines 38, which are constructed in the form of a control bus within the system bus 32, with a brake unit 36 which acts on the drive pulleys 42 of the elevator installation 10.

FIG. 1 shows the elevator installation after exchange of a previously installed, conventionally wired safety circuit, which comprised shaft door switches, car door switches and brake control switches, for the described components connected with a system bus 32. Beyond this, the evaluating unit 28 is electrically connected in a conventionally wired safety circuit 60 with other still-existing components of the elevator installation, namely with a buffer switch 54 of the buffer 52 for the elevator cars 12, 14 and a speed limiter cable switch 58 of a speed limiter cable 56, for monitoring thereof.

Figure 2:
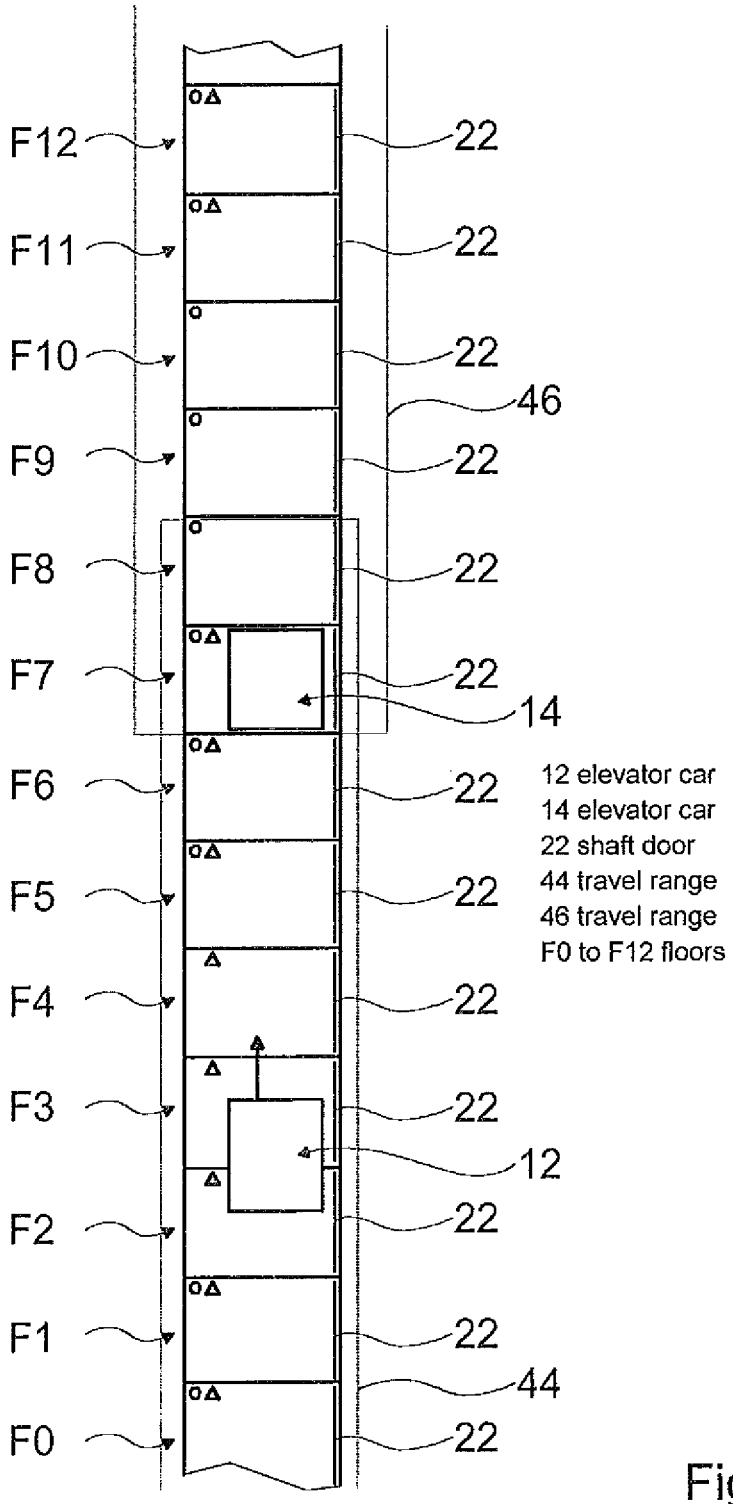
FIG. 2 shows a technical safety status of the elevator installation in a typical operating situation.

FIG. 2 describes, for a typical operating situation of the elevator installation 10 with illustrated floors from F0 to F12, the technical safety status of the shaft doors 22 at the end of an evaluating process by the evaluating unit 28. An illustrated travel range 44 for the first elevator car 12 and a travel range 46 for the second elevator car 14 were determined by an installation control (not described in more detail). The first elevator car 12 is disposed, in the instantaneous situation, between the floor F2 and the floor F3, with the floor F4 as the currently planned destination. The second elevator car 14 is at the floor F7 and has the floor F10 as the currently planned destination.

The opening authorizations, which are granted by the evaluating unit 28 in this situation, for the shaft doors 22 are illustrated in FIG. 2 by corresponding symbols. In that case, an empty circle in a floor F0-F12 indicates that the evaluating unit 28 has granted an opening authorization to the shaft door 22 of this floor F0-F12 on conclusion of the last-performed evaluating process for isolated monitoring of the first elevator car 12. This is symbolized for the second elevator car 14 by an empty triangle in the respective floor F0-F12.

For isolated monitoring of the first elevator car 12 the evaluating unit 28 has granted to each of the shaft doors 22 of the floors F9 to F12 a respective opening authorization, since the floors F9 to F12 are located outside the travel range 44 released for the first elevator car 12.

The evaluating unit 28 has, for isolated monitoring of the second elevator car 14, granted a respective opening authorization to each of the shaft doors 22 of the floors F0 to F6, since the floors F0 to F6 are located outside the travel range 46 released for the second elevator car 14.

For the isolated monitoring of the first elevator car 12 the evaluating unit 28 has not granted opening authorizations to the shaft doors 22 of the floors F2 and F3, because the elevator car 12 is, in fact, currently in the approach region of the shaft doors 22 of the floors F2 and F3, but is in travel and a limit value for a maximum speed of the elevator car 12 is exceeded.

For isolated monitoring of the second elevator car 14 the evaluating unit 28 has granted an opening authorization to the shaft door 22 of the floor F7 because the second elevator car 14 is in the approach region of the shaft door 22 of the floor F7 and the limit value for a maximum speed of the elevator car 12 has been fallen below.

The evaluating unit 28 has, for isolated monitoring of the first elevator car 12, granted an opening authorization to the shaft door 22 of the floor F8, since the second elevator car 14 is located between the shaft door 22 of the floor F8 and the first elevator car 12.

The evaluating unit 28 has, for isolated monitoring of the first elevator car 12, granted a respective opening authorization to each of the shaft doors of the floors F0 and F1, since the elevator car 12 is travelling in a direction away from the shaft doors 22 of the floors F0 and F1.

For isolated monitoring of the first elevator car 12 the evaluating unit 28 has granted a respective opening authorization to each of the shaft doors 22 of the floors F5 to F8, since the shaft doors 22 of the floors F5 to F8 lie outside the currently planned travel route of the first elevator car 12 to the destination thereof, namely the floor F4.

For isolated monitoring of the second elevator car 14 the evaluating unit 28 has granted a respective opening authorization to each of the shaft doors 22 of the floors F11 and F12, since the shaft doors 22 of the floors F11 and F12 lie outside the currently intended travel route of the second elevator car 14 to the destination thereof, namely the floor F10.

On the basis of the symbols for the instantaneously granted opening authorizations of the shaft doors 22 of this elevator installation 10 the advantage with respect to the transport capacity thereof for the case of an unauthorized opening of a shaft door 22 is clearly recognizable.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation including at least two elevator cars, each car having at least one elevator car door and which are moved independently of one another in a common shaft, a plurality of shaft doors in the common shaft, and a safety device, which safety device includes at least one door opening sensor, at least one evaluating unit and at least one data line connected between the at least one door opening sensor and the evaluating unit, the evaluating unit being responsive to a signal from the at least one door opening sensor for evaluating the signal in at least one evaluating process, and for granting an opening authorization to a one of the shaft doors as a result of the evaluating process in dependence on at least one of positions, speeds and travel directions of the at least two elevator cars, comprising:

the evaluating unit granting the opening authorization to the one shaft door when the one shaft door is located outside a planned current movement path of a one of the elevator cars to a destination floor.

2. The elevator installation according to claim 1 wherein the evaluating unit, in response a signal from the door opening sensor representing an unauthorized opening of the one shaft door, prevents travel of the one elevator car into an approach region of the one shaft door or travel past the one shaft door.

3. The elevator installation according to claim 1 wherein the at least one door opening sensor is a shaft door opening sensor.

4. The elevator installation according to claim 1 wherein the data line is a bus connected to the at least one door opening sensor by at least one bus junction.

5. The elevator installation according to claim 1 including a brake unit for the one elevator car connected by a control line to the evaluating unit, the control line being a system bus.

6. The elevator installation according to claim 1 including an elevator car position unit for sensing an absolute position of each of the at least two elevator cars within the shaft.

7. The elevator installation according to claim 1 wherein the evaluating unit monitors a relative spacing of the at least two elevator cars.

8. The elevator installation according to claim 1 wherein the evaluating unit monitors the one elevator car for granting the opening authorization to the one shaft door when the one elevator car is disposed in an approach region of the one shaft door and a speed of the one elevator car is below a limit value for a maximum speed of the one elevator car.

9. The elevator installation according to claim 1 wherein the evaluating unit monitors the one elevator car for granting an opening authorization to the one shaft door when another one of the at least two elevator cars is disposed between the one shaft door and the one elevator car.

10. The elevator installation according to claim 1 wherein the evaluating unit monitors the one elevator car for granting an opening authorization to the one shaft door when the one elevator car travels in a direction away from the one shaft door.

11. The elevator installation according to claim 1 wherein the safety device monitors a conventionally wired safety circuit of the elevator installation.

12. A method of monitoring an elevator installation having at least two elevator cars each having at least one elevator car door and are moved independently of one another in a common shaft, a plurality of shaft doors, a door opening sensor communicating at least one signal by a data line to an evaluating unit of a safety device, the at least one signal being evaluated in an evaluating process by the evaluating unit, and the evaluating unit granting an opening authorization to a shaft door as a result of the evaluating process in dependence on at least one of positions, speeds and travel directions of the at least two elevator cars, comprising the steps of:

operating the evaluating unit to detect that the shaft door lies outside a planned current movement path of one of the at least two elevator cars to a destination floor; and operating the evaluating unit to grant the opening authorization to the shaft door when the evaluating unit detects that the shaft door lies outside the planned current movement path of the one elevator car to the destination floor.

13. The method according to claim 12 including operating the evaluating unit, in response to an unauthorized opening of the shaft door, to prevent travel of the one elevator car into an approach region of the one shaft door or travel past the one shaft door.

14. A safety device of an elevator installation including at least two elevator cars, each car having at least one elevator car door and which are moved independently of one another in a common shaft, a plurality of shaft doors in the common shaft, the safety device comprising:

at least one door opening sensor;

at least one evaluating unit; and at least one data line connected between the at least one door opening sensor and the evaluating unit, the evaluating unit being responsive to a signal from the at least one door opening sensor for evaluating the signal in at least one evaluating process, and for granting an opening authorization to a one of the shaft doors as a result of the evaluating process in dependence on at least one of positions, speeds and travel directions of the at least two elevator cars, the evaluating unit granting the opening authorization to the one shaft door when the one shaft door is located outside a planned current movement path of a one of the elevator cars to a destination floor.

* * * * *